US005369857A

United States Patent [19]

Sacherman et al.

[11] Patent Number: 5,369,857

[45] Date of Patent: Dec. 6, 1994

[54] METHOD OF MAKING A TELEPHONE HEADSET

[75] Inventors: Jim Sacherman; John Toor, both of Palo Alto, Calif.

[73] Assignee: Hello Direct, San Jose, Calif.

[21] Appl. No.: 986,915

[22] Filed: Dec. 8, 1992

[51] Int. Cl.[5] ..... H04R 31/00

[52] U.S. Cl. ..... 29/594; 379/430; 381/183; 381/187

[58] Field of Search ..... 29/594, 592.1; 381/183, 381/187; 379/430

[56] References Cited

U.S. PATENT DOCUMENTS

| | | | |
|---|---|---|---|
| D. 153,112 | 3/1949 | Braun et al. | D26/14 |
| D. 286,874 | 11/1986 | Bertagna et al. | D14/36 |
| D. 287,849 | 1/1987 | O'Malley et al. | D14/36 |
| D. 292,205 | 10/1987 | Kikutani | D14/36 |
| 1,555,997 | 10/1925 | Lidberg . | |
| 3,681,540 | 8/1972 | Thomson | 381/183 |
| 4,588,868 | 5/1986 | Bertagna et al. . | |
| 4,634,816 | 1/1987 | O'Malley et al. | 379/430 |
| 4,689,822 | 8/1987 | Houng | 381/183 |

FOREIGN PATENT DOCUMENTS

| | | |
|---|---|---|
| 3231218A1 | 2/1984 | Germany . |
| 1172086 | 8/1985 | U.S.S.R. . |

*Primary Examiner*—Carl E. Hall

*Attorney, Agent, or Firm*—Haverstock, Medlen & Carroll

[57] ABSTRACT

A telephone headset uses extruded thermoplastic with a pair of embedded steel wires to make the headband and microphone boom. The extrusion is formed by feeding the two wires through the extruding die along with the hot plastic. The two wires serve to stiffen the extrusion and also as electrical conductors. The material is cut to length and joined to earphones, microphones and telephone cable to make the headset; the two wires conduct the sound signals to the earphone distal the telephone cable attachment. The extrusion material retains a twist, which allows for angular adjustment of the earphones. A hinge and spring cant the headphone inward at the bottom for greater comfort, and to adjust the angle to the user's head. In a second embodiment, one of the wires is removed after extrusion to leave a tunnel through the extruded material. Small electrical leads can be passed through the tunnel, and the remaining wire remains as a stiffener. The fine leads allow rotation of the boom about the earphone or headband without the need for a complicated electrical connection.

10 Claims, 3 Drawing Sheets

METHOD OF MAKING A TELEPHONE HEADSET

BACKGROUND OF THE INVENTION

The field of the invention is headphones, including headphone-microphone headsets.

Headsets are commonly used by telephone operators, receptionists, and others who need to keep their hands free while listening and speaking over a telephone or other voice link. Typically these headsets will have a headband passing over the user's head, with an earphone at each end of the band and a microphone riding at the end of a boom extending from the headband. A lightweight cable, typically having three or four wires, leads from the headset to a telephone connection. The cable is attached to an earphone at one end of the headband to keep it out of the way. Often, the cable is coiled to provide a quasi-variable length interconnection.

The headset should be both tough to avoid damage, and light in weight so as not to tire the user, who often will wear the headset continuously through a work shift.

The headband is resilient and shaped into an arc so that it must be slightly sprung to fit over the head; the resulting friction force holds the band in place on the user's head. Since the band is the largest piece in the typical headset, its design is important in obtaining a durable, light headset.

Some headsets employ a single earphone, which saves some weight and expense. However, double earphones allow better hearing, both by doubling the sound energy to the user and by partially blocking outside noise from both ears. If double earphones are used, then electrical connection must be made to both earphones.

Since the cable is attached to the headset at one end of the headband near one of the earphones, two leads (conductive wires or lines) must be run along the headband to the other earphone. If no leads are run over the headband, then a separate cable must be run to either earphone. This is done in some belt-clip radios and tape decks, such as those sold by Sony Corporation under the trade name "Walkman." The two-cable arrangement is inconvenient when the cables are to be put over the shoulder, and the likelihood of cable damage is increased, both because there is an extra cable to be broken and because the two cables often become twisted.

To run the signal leads over the headband also causes design problems. The wires should be a fine gauge to keep the weight and cost low but they must resist breaking and tearing during both manufacture and use. They must be held closely to the headband or they will snag on something and break. They should be hidden for aesthetic reasons requiring extra manufacturing steps.

A better headset design would have fewer and sturdier parts than the band, wires, and wrapping structure. Ideally, the band would consist of the minimum number of parts: two conductors and one insulator. It should be sturdy enough to resist abuse and wear. If the signal conductors are fine wire leads, then they should be protected to avoid snagging and breakage.

Besides a tough, light headband, another requirement of a headset is that it be comfortable for long wear. A common source of discomfort in many headbands is pressure against the outer ear by the earphones.

A certain amount of force against the ears is required to hold the headset in place. As mentioned above, only friction is available to prevent the earphones from sliding sideways away from the ears. The sideways force to resist such sliding is a function of the coefficient of friction of the earphone against the ear, and the force pushing the earphone against the head. Given the mass of the earphones and headband and the friction coefficient, the minimum force is fixed.

Even with a light-weight headset and soft, high-friction cushion material such as foam, the force required is still great enough that the ears will become sore if the needed force is concentrated on one part of the ear. This will happen if the earphones are cocked, and do not sit squarely on the outer ear.

To prevent this, prior-art earphones have used various hinged joint structures to allow free rotation of the earphones.

One approach is to use ear plug-type earphones rather than larger external earphones. These, however, tend to clog with ear wax, may make the ear canal sore with long use, and cannot easily hold a microphone boom and its hinge.

With external earphones, prior designs have employed two basic approaches. The first is ball-and-socket; the second is external-yoke gimbals.

The ball-and-socket joint is simple to design and make with plastics, which allow a snap-in design. However, it has functional drawbacks.

First, the headband cannot stay close to the user's temple because the ball-and-socket joint is relatively thick. It will normally will be directly behind the sound transducer, so the whole earphone must be thicker still. The earphone must rotate about, and clearance is needed for the edge to swing without hitting the headband. All this means that the headband must be coupled to the earpiece a relatively far distance from the side of the head, which can lead to snagging.

Second, the earphone can rotate in all directions, including rotation about an axis pointing into the head (parallel to the ear canal). This means that when a microphone boom is attached to one of the earphones, the weight of the boom will rotate the earphone and the boom will droop. The telephone cable may also rotate out of its position on the bottom of the earphone and wrap about the ear.

The external-yoke gimbal design usually employs an outer yoke rotating on a pivot pin lying along the headband, and an inner ring whose hinge axis is horizontal. The two hinge axes are crossed, which allows earphone rotation in any direction.

The gimbal structure is complex and, being external to the headset structure, is prone to damage. It is also bulky: if the gimbal is small it must be outside the earphone, making for a thick structure as with the ball-and-socket joint; if the gimbal rings or yokes surround the earphone, the width is very great.

Both the ball-and-socket and the external-yoke designs place the center of rotation of the earphone near the geometrical middle of the earphone. The middle of the earphone, where the sound transducer is located, is in use placed directly over the ear canal for best hearing. The resilient force of the bowed headband is exerted at the center of rotation, and the force is evenly distributed around the perimeter of the earphone, that is, evenly distributed in a circle centered on the ear canal.

This distribution of force is not the ideal. The upper parts of the outer ear extend farther away from the sound-sensitive ear canal than do the lower parts: in fact, the only lower part to speak of is the earlobe. A moderately-sized earphone edge will push against the upper parts of the outer ear and skirt the lower parts. The upper parts are more sensitive, having delicate cartilage structures; pressure against them is more uncomfortable than pressure against the earlobe. The sensitivity is increased if eyeglass frames are trapped between the outer ear and the head.

A better distribution of pressure would exert greater force against the areas below the ear canal. These areas include the ear lobe, neck, and jaw. The prior art does not teach this distribution of force.

SUMMARY OF THE INVENTION

The present invention relates to an improved telephone headset. The present headset preferably uses an extruded band of wire and plastic for making both the headband and microphone boom, and a novel method of hinging the earphone. The extrusion and the headset each have several embodiments.

The headband of the present invention consists of two parallel lengths of solid, conductive metal wire inside a thermoplastic extrusion. The band material is formed by a continuous extrusion process, which is conventional. The preferred materials are nylon and high carbon steel "music wire".

The nylon can be colored, sized and shaped to suit. The music wire diameter, temper and alloy is chosen for the proper resilience, so that the headset will stay on the user's head but not hurt his or her ears by excess force.

The extruded headband material is cut to the headband length and bent to curve around the headset wearer's head. Electrical connections are made to the ends of the music wire, which serve as electrical signal conductors to drive the earphone on the other side of the head from the telephone cable connection. The earphones and telephone cable connections are attached, and the microphone boom is mounted if desired.

The earphone at either end of the headband must rotate to fit comfortably onto the user's ears. Each earphone rotates over a limited distance about two substantially perpendicular axes. The present invention uses a hinge for the rotation of each earphone of each earpiece about a horizontal axis (rolling), and relies on the properties of the extrusion for rotation about a vertical axis (yawing).

The extrusion allows earphone yawing because, when twisted, it will retain any imposed torsion to remain in the new twisted position. The user need only wring the headset to set the angles of the earphones to the appropriate yaw. The retention of torsion occurs due to the internal friction between the extrusion's nylon sheath and the embedded wires. Sufficient torque will break the wire loose from the nylon and cause torsion; less torque will leave the wires in place against the nylon sheath.

The hinge, for the "rolling" rotation, is spring-loaded to exert greater force against the areas below the ear canal. This improves the comfort of the headset.

The invention may include a microphone boom attached to one of the earphones. A boom which can rotate is desirable for three reasons: first, its position should adjust to various users; second, the headset can be made left-right reversible if the boom rotates to either side; and third, the boom should swing up parallel to the headband to reduce the headset bulk for shipping or storage.

To avoid the need for a rotary electrical connection to the boom, the present invention uses loops of braided wire to connect between the earphone housing and the boom. The leads continue on to the microphone. The boom contains a tunnel for the leads to run through. The boom is preferably an extrusion similar in cross section and color to the headband extrusion.

The boom extrusion tunnel is made by cutting a length of the extrusion and then removing one of the wires. The wire to be removed can be caused to adhere less well to the nylon making the removal easier. The adherence can be decreased either by making the wire of copper, or by using high carbon steel wire and not heating it during the extrusion. The high carbon steel wire adheres best if it is heated to the temperature of the nylon in the die. With either method the wire is more easily removed.

The one remaining wire in the boom is annealed so that it can be easily bent to the proper shape to be near the wearer's mouth.

BRIEF DESCRIPTION THE DRAWING

DETAILED DESCRIPTION OF THE BEST MODE OF THE INVENTION

Figures 1, 2, 3:
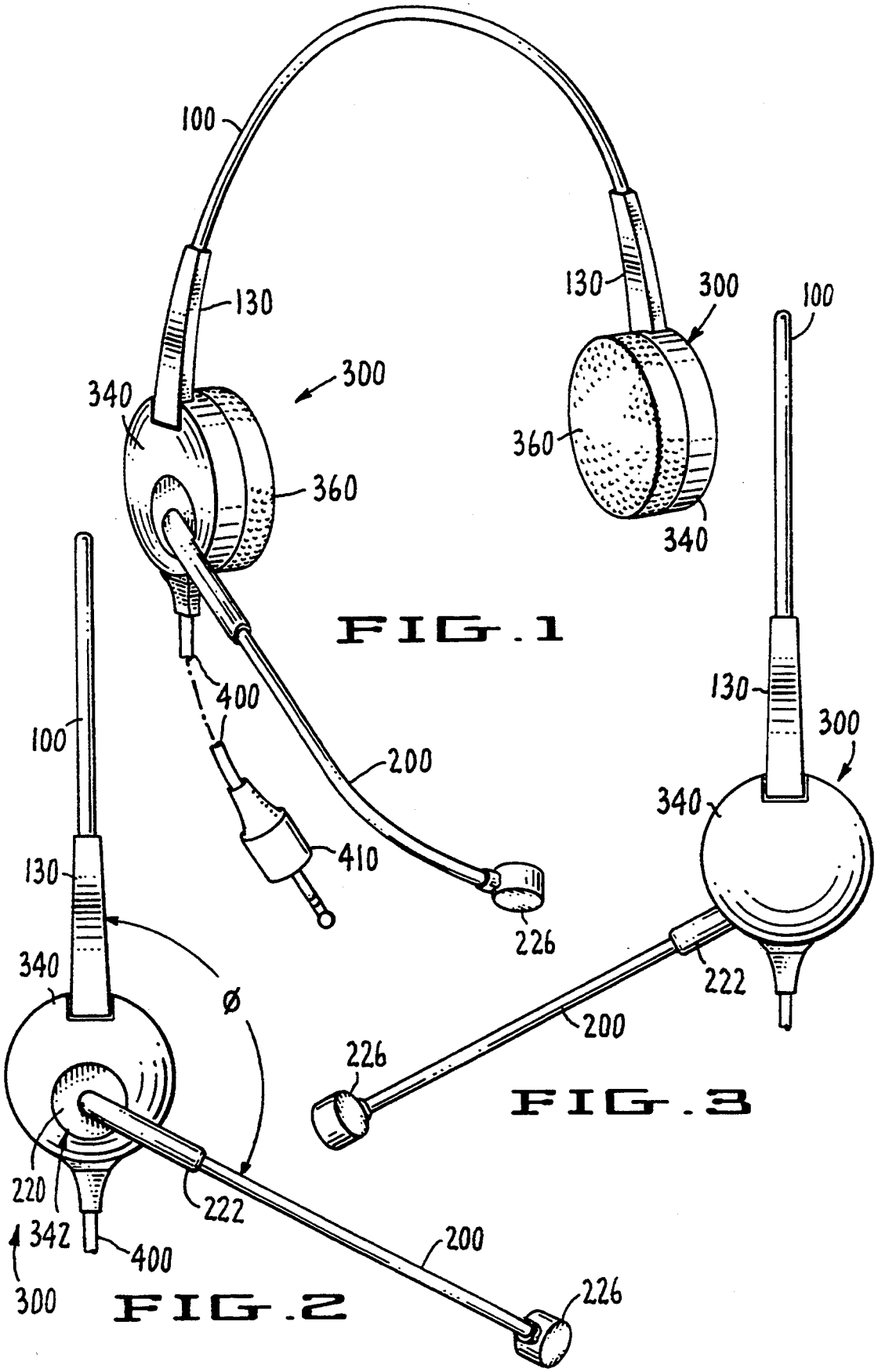
FIG. 1 is a perspective view of the headphones of the present invention.
FIG. 2 is an elevation view of the headset showing the angle $\phi$ between headband and the boom.
FIG. 3 is also an elevation view of the headset.

The headset of the present invention is shown in an overview in FIGS. 1–3. A headband 100 resiliently joins a pair of earphones 300. Each earphone 300 includes a housing 340 and a cushion 360 which is made of foam or other soft material. A strain relief or collar 130 fits over either end region of the headband 100 to stiffen it. The headband 100 can slide within the collar 130. The collar 130 is hingedly joined to the earphone housing 340 in the preferred embodiment, as discussed below.

The invention may optionally include a microphone boom 200 and microphone 226. A swivel plate 220 rotates on the housing 340 within a housing aperture 342. The swivel plate 220 snaps into the housing aperture 342. The boom 200 is inserted into a stabilizing extension 222 integrally molded with the swivel plate 220. The microphone 226 is mounted at the end of the boom 200, distal the housing 340.

Figure 6:
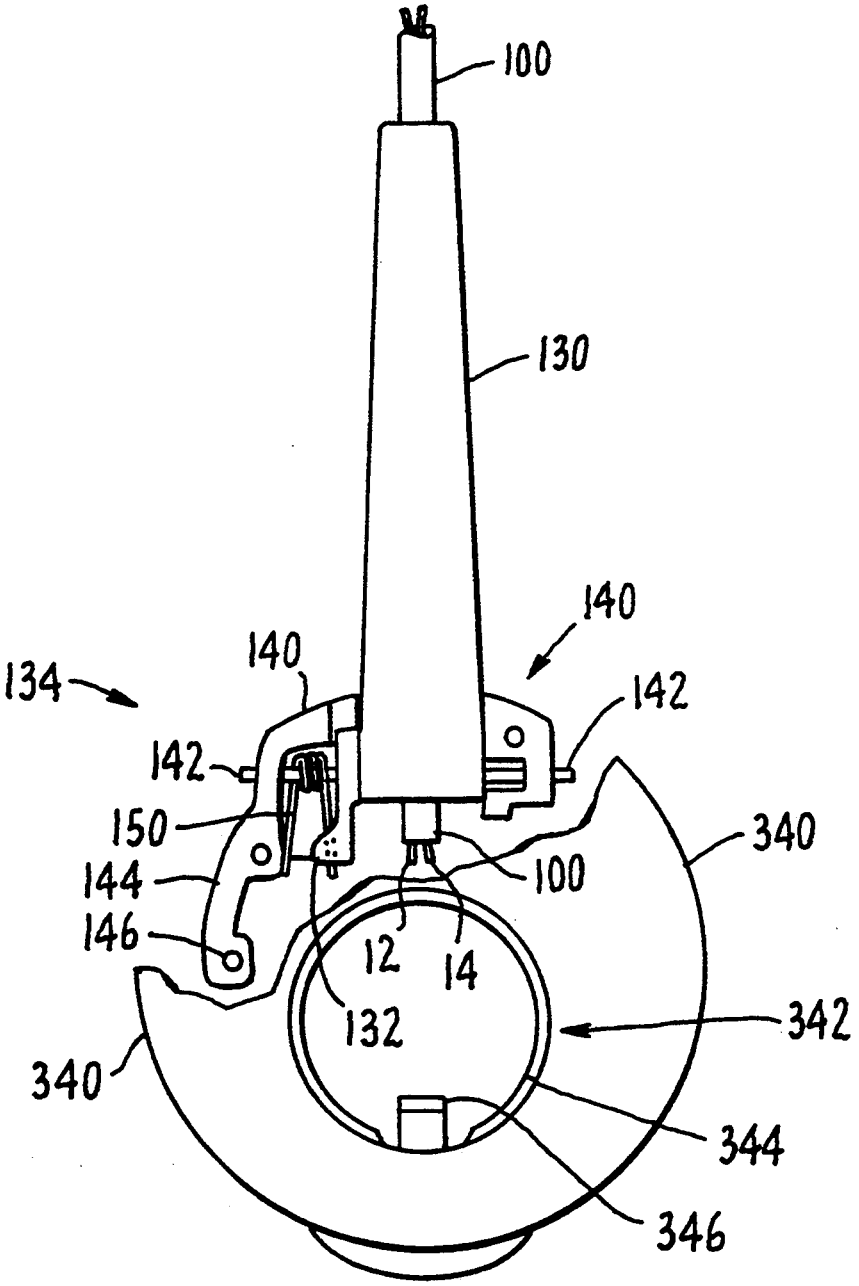
FIG. 6 is an elevation view of the earphone hinge in partial cutaway.

FIG. 2 shows that the boom 200 forms an angle $\phi$ with the band 100. This angle $\phi$ varies as the swivel plate 220 rotates on the housing 340. The swivel plate 220 has a circumferential groove (not shown) which is snap-fitted into a corresponding circular rim 344 (shown in FIG. 6) inside the aperture 342. The groove and rim include stops which limit the angle $\phi$. The stop 346 of the aperture 340 is shown in FIG. 6.

The boom 200 can rotate from the position shown in FIG. 2 upward past the headband 100 and over to the other side; the total angle through which the boom 200 is allowed to rotate is approximately 300 degrees. (That is, the angle $\phi$ varies from about 150 degrees to about −150 degrees.) This allows the headset to be used with the boom 200 and telephone connection cable 400 on either the right or on the left side of the user's head.

A pivotal boom is also desirable because it allows adjustment to the heights of various users' mouths, and because the boom can swing up parallel to the headband to reduce headset bulk for shipping or storage.

A signal cable connection cable 400 is coupled to that earphone 300 on which the boom 200 pivots. The cable 400 includes a plug 410. The cable 400 carries electric signals to the earphones 300 and from the microphone 226. The electronic parts of the earphones 300 and of the microphone 226 are conventional and well known in the art.

Figure 4:
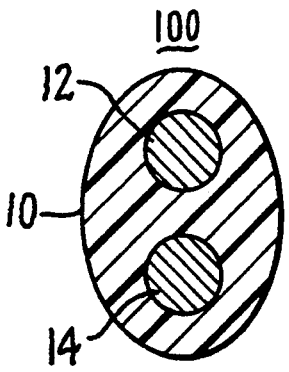
FIG. 4 is a cross-section view of the extruded headband/boom material in a first embodiment with two embedded wires.

Referring now to the cross section view of FIG. 4, the headband 100 of the present invention consists of two parallel lengths of solid, conductive metal wire 12 and 14 inside an insulating thermoplastic sheath 10. The headband material is preferably formed by a continuous extrusion process so that the transverse cross section is uniform and the cross section of the extrusion is minimized. In this process a suitable thermoplastic material is forced through an extrusion die hole, and the pair of solid metal wires are simultaneously fed through the hole along with the hot thermoplastic. The extrusion process, and the equipment for performing it, are conventional and are not shown in the drawing.

To form the extrusion, the wires 12 and 14 are fed through the die hole in such positions that they are spaced apart from both one another and from the edges of the die. As the extruded thermoplastic leaves the die and cools, the two wires are frozen into their positions within the thermoplastic strip. The resulting extrusion, with two solid, resilient metal wires 12 and 14, insulated within a plastic sheath 10, is the material from which the headband 100 is made. The wires 12 and 14, are insulated from each other and from the outside, and are protected by a thick layer of tough plastic 10. They act both as a pair of electrical conductors and also as mechanical stiffeners.

The thermoplastic material can be colored, sized and shaped to suit any design criteria, and wire is readily available in many diameters, tempers and materials: so the headband design can be adjusted to obtain an attractive, inexpensive, light-weight, and tough structure. The resilience can be adjusted by picking the temper, alloy, and diameter of the wires so that the final headset will stay on user's head but not hurt the ears. Many metals will allow the extruded headband strip 100 to retain a new shape if bent beyond the elastic limit.

To begin manufacture of a headband 100, the extrusion is cut to the appropriate headband length. The ends of the wires 12 and 14 are exposed for electrical connection; signal leads may be soldered or crimped onto the exposed wire ends, or other conventional electrical couplings made, to allow the pair of wires to serve as electrical signal conductors to drive the earphone distal the cable connection.

The preferred materials for the extrusion are nylon and high carbon steel "music wire". Nylon is tough, relatively inexpensive, low-friction, and colorless (so that it can readily be dyed any desired color); music wire is commercially available in many diameters, has a high yield point, is inexpensive, and is conductive enough that no appreciable power will be lost by the electrical signals which traverse the band. Music wire inside the nylon sheath can be bent to fit various user's heads without significant work hardening which would cause the headband to kink.

High carbon steel adheres fairly well to nylon. This makes the extrusion stiffer than it would be if the friction were quite low (as would be the case with teflon plastic, for example). However, the adherence between nylon and high carbon steel is not so great that the wires' outer surfaces cannot break loose from the nylon, and the wires move within their respective tunnels.

Because each wire can slip to a new position, the extrusion material will retain a twist (torsion). When sufficient torque is exerted along a length of the material, the two ends will relatively rotate to a new angle, and stay there. Internal friction between the wires and the nylon sheath prevents the extrusion from returning to its original untwisted state, so the torsion is retained.

The retention of torsion is a function of the dimensions of the extrusion and of the properties of the materials. The coefficient of static friction between the nylon sheath 10 and the wires 12 and 14 determines how much torque will cause the high carbon steel surfaces to rotate within the nylon sheath. The modulus of elasticity of the nylon sheath, and the moduli of elasticity of the wires 12 and 14, also determine how much torque is needed to cause torsion. Other mechanical properties may also influence the behavior of the extrusion 100.

While it has been found that high carbon steel and nylon are well-suited to the retention of torsion, other materials with suitable properties can also be used. Such materials may be found by experimentation, by calculating from their known mechanical properties, or by other means.

When the extrusion is used as a headband 100, this property of retaining torsion provides a needed adjustment of the earphone 300 angle. To fit various wearer's heads without pinching the ears, the earphones 300 must adjustably rotate or twist about two axes. One twist, herein denoted "yaw," is rotation about a vertical axis alongside of the wearer's ear. The other twist, herein called "roll," is earphone rotation about a horizontal axis parallel to the wearer's line of sight.

In further defining the two rotations, it may be noted that yawing changes the angle between the plane of the earphone housing 340 and the plane in which the headband 100 lies, while rolling does not; and that the boom angle $\phi$ shown in FIG. 2 represents a pitching rotation about an axis generally perpendicular to both the yawing and the rolling axes.

It will be seen in FIGS. 1 and 2 that the earphone yaw adjustment axis aligns with the end region of the headband 100 adjacent the wearer's temple, near to the earphone 300. Thus, a twist in the headband 100 adjusts the earphone yaw angle.

With the extrusion of the present invention, the user need merely grasp either earphone 300 and wring the headset into a new configuration. If it happens that the yaw angle is not precisely set by this method, it will cause no discomfort, because the extrusion also acts as a resilient torsion rod until it is torqued past a certain point, when the extrusion slips into a new yaw position.

In the preferred embodiment of the present invention, a hinge 134 is incorporated between the housing 340 and the collar 130 to allow the earphone 300 to roll to the correct angle for lying on the user's ear. The hinge 134 has an axis which lies horizontally in the plane of the paper in FIG. 2. The hinge 134 allows each earphone 300 to cant (i.e., roll inward at the bottom) and prevent pressure against the upper parts of the outer ear with resultant discomfort. The hinge 134 includes an internal torsion spring or other resilient means to urge the earphones 300 toward a position in which, as shown in FIGS. 2 and 3, the upper part of the housing 340 is closer to the viewer than the lower part; that is, a position in which the lower part of the earphone 300 is closer to the user's head to decrease force against the upper parts of the ear. Here, and in the following claims, this position, which results from rolling of the earphone, will be referred to as "canted".

Referring now to FIG. 6, the mechanism of the hinge 134 of the preferred embodiment is shown. The view is looking toward the side of the user's head. The hinge 134, which is shown in FIG. 6, is hidden when the headset is assembled; but in FIG. 6 the circular rim of the earphone housing 340 is partially cut away to reveal it. The housing aperture 342, into which the swivel plate 220 snaps, is also shown.

The collar 130 pivots on a molded plastic part 140, which is shaped to fit closely into a corresponding section of the housing 340. When the earphone 300 is assembled completely, the part 140 is locked into that position, shown in FIG. 6, in the housing 340.

A first transverse hole passes through part 140 and a second hole, aligned with the first hole, passes through collar 130. A metal hinge pin 142 is disposed through the holes. The rolling of the earphone 300 hinges about the pivoting axis of the pin 142.

Figure 7:
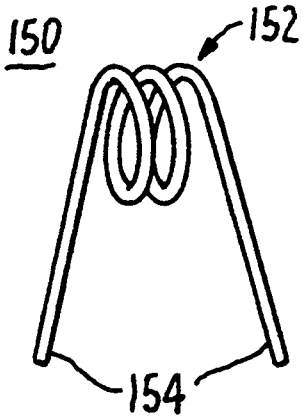
FIG. 7 is a perspective view of the hinge spring.

The pivoting force to cant the earphone 300 is provided by a torsion spring 150, also shown by itself in FIG. 7. The spring 150 is formed of a single length of wire. It has a central coil 152 and straight arms 154 extending outwardly from alternate ends of the central coil. (This type of spring is commonly found in clothes pins, mouse traps, and hand-grip exercisers.) The pin 142 passes through the coil and is enclosed by its turns.

One of the arms 154, shown on the left in FIG. 6, bears against the part 140, in a direction into the paper; the other arm 154, shown on the right side, bears outward from the plane of the paper against a tab 132 of the collar 130. The opposing forces cant the earphone 300. To better distribute the force from the part 140 to the housing 340, the molded part 140 includes a leg 144 which bears against the housing 340. A hole 146 in the leg 144 accepts a pin molded into the housing 340 for better locking between the housing 340 and the part 140.

The part 140 and the collar 130 include bearing surfaces to limit the relative pivoting to those angles needed to accommodate various users' ears comfortably.

The hinge design of the present invention not only provides greater force by the lower part of the earphone 300, but also avoids the thickness, bulk, and protruding or rings of the prior art designs. In addition, the internal hinge will not snag and lends itself to clean lines for aesthetic headset design.

The principle of exerting greater force against by the lower edge of the earphone against the head may be used without the torsion-retaining headband: however, the two interact to provide all degrees of freedom for the earphones. This principle may also be incorporated in other structures, which might use the resilient force of the headband or rubbery materials of the earphone, as well as or instead of the discrete hinges and springs of the preferred embodiment.

It is to be noted that in the preferred embodiment, the torque, generated by the spring 150 between the collar 130 and the earphone 300, cooperates with the position of the hinge 134 to yield a comfortable ear pressure. If the hinge were higher or lower, the force differential would be different.

Both the earphone hinge with canting force and the torsion-retaining headband can be used with a single-earphone embodiment of the present invention. In this alternate embodiment the two wires 12 and 14 do not function as signal conductors, but their mechanical properties are still useful. (Their electrical properties may of course be useful for an antenna, or other application.) The hinge 134 is equally well adapted to a single earphone as to double earphones.

The same extrusion material can be used for the headset microphone boom 200 as well as the headband 100. The use of the same material for the headband 100 and boom 200 has aesthetic advantages as well as manufacturing advantages.

Preferably, the boom 200 extrusion incorporates music wire with less temper than the wires used in the headband 100 extrusion. The use of partially annealed wire allows the microphone boom 200 to be easily bent into that shape in which the microphone 226 is at the appropriate speaking distance from the lips.

In a microphone boom it may be difficult to make the two needed electrical connections to the music wire in the extrusion, both because the microphones used in headsets are very small and because the microphone boom should rotate about one of the earphones. A rotatable electrical connection is complex and expensive. Simple leads of insulated, fine, braided wire arranged in a loop can twist through the needed angle can accomplish the same function as a sliding connection. However, the leads must be prevented from turning through large angles, or they will twist off.

To prevent the leads from being twisted past the breaking point, the swivel plate 220 and housing aperture 342 include stops (as discussed above) to prevent rotation of the boom 200 beyond that angle $\phi$, which is the greatest angle to which a headset user might need to set the boom 200 so as to place the microphone 226 near his or her mouth.

If fine wire leads are used in place of a rotating connector for coupling to the microphone 226, then the most convenient, simple and inexpensive design is to also use the leads as the only connection between the microphone 226 and whatever electrical point within the housing 340 the microphone connects to. Thus, it is preferable to run the fine leads through the boom 200.

To run the leads through the boom 200 with the extrusion of the present invention, the manufacture of the extrusion is preferably modified for the boom 200 material. After the extrusion is cut to a boom length, one of the solid wires is pulled out. (This wire is not shown in drawing FIG. 5.) The result is like the headband extrusion as described above and shown in FIG. 4, but, the boom extrusion has within the sheath 20 one length of music wire 22 and one void or tunnel 24 where the second wire would have been (i.e., wire 12 or 14 of FIG. 4). The tunnel 24 serves as a conduit for the pair of leads 240, shown in FIG. 5, which connect the microphone 226 at the end of the boom 200 to the proper connections inside the housing 340. No extra connections from music wire to leads are needed, nor any rotational electrical connection.

(The boom length is generally, but not necessarily, different from the headband length cut from the extrusion material to make the headband. The boom extrusion and the headband extrusion, even if containing different sorts of wires or voids, are preferably similar in outline, color, and material. This improves the appearance of the headset. With prior-art designs, it was difficult to match the appearances of the headband and boom.)

Figure 5:
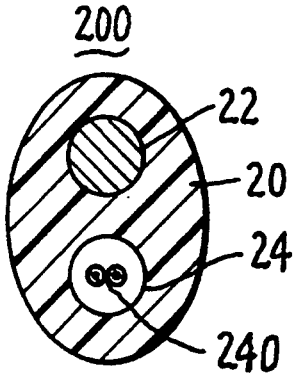
FIG. 5 is a cross-section view of the extruded headband/boom material in a second embodiment with one embedded wire and one tunnel.

In manufacturing the modified one-wire, one-tunnel extrusion or strip of FIG. 5, it is helpful to decrease the adhesion between that wire to be removed and the nylon, so that the wire is easily pulled out to leave the tunnel. Since nylon is naturally slippery, this operation is not difficult if the adhesion is low and the boom length is not too great.

The adhesion between the high carbon-steel music wire and the extruded nylon can be varied by adjusting the temperature of the wire as it passes through the extruding die. If the wire temperature is as high as the temperature of the molten nylon, then the wire adheres well to the nylon in the cooled extrusion; if the wire temperature is cooler than the nylon temperature, then the adhesion is measurably less and the colder-extruded wire can be pulled out readily.

Another method for manufacturing the boom length is to use an extrusion with one high carbon steel wire and one copper wire. Copper has less adhesion to nylon than high carbon steel has. The copper wire is removed to leave the tunnel, and the high carbon steel wire is left in place for mechanical stiffening.

Either embodiment of the extrusion, two-wire or one-wire, may be used interchangeably in either the headband or the microphone boom of a headset, or in any other part of a headset; the present invention is not restricted to two-wire extrusions in the headband and single-wire, single-tunnel extrusions in a boom. Double-tunnel extrusions may also be used in a headset. The various wires and tunnels may be of different diameters. The single-wire boom 200 extrusion may retain torsion in the manner of the double-wire headband extrusion 100.

In the following claims, "sound transducer" means any device which: converts electrical or magnetic signals into sound waves, such as an earphone or loudspeaker; or which turns sound waves into electrical or magnetic signals, such as a microphone.

"Torsion-retaining headband" means a headband made from elongated material which can be repeatedly wrung or twisted into a new state of permanent twisted distortion (i.e., torsion) without being damaged by such wringing. Thus, a simple metal rod could not be a torsion-retaining headband under this definition because work hardening and metal fatigue would change the metal's properties. A torsion-retaining member will usually, but not necessarily, involve internal friction between two or more elements.

"Rotation" in the following claims indicates pitching, as shown by the angle $\phi$ of FIG. 1.

We claim:

1. A method of making a headset, comprising the steps of:

a) forming an extrusion by forcing molten thermoplastic through a die, the die having an edge defining an extrusion transverse cross section shape, the thermoplastic emerging as a solidified strip at an extrusion speed;

b) simultaneously feeding a plurality of metal wires through the die at the extrusion speed, the wires separated from the edge and from each other, whereby the wires will be embedded internally within the solidified strip and electrically isolated;

c) cutting the extrusion to a headband length;

d) exposing a sufficient portion of the wires for making electrical connections thereto;

e) electrically coupling the wires to a first sound transducer; and f) pivotably coupling the first sound transducer to the headband length by resilient means for urging the first sound transducer toward a canted angle with the extrusion.

2. The method according to claim 1, wherein the wires include a pair of steel wires.

3. The method according to claim 1, wherein the thermoplastic is nylon.

4. The method according to claim 1 wherein the first sound transducer includes an earphone; and wherein the step of pivotably coupling includes attaching the earphone to an end region of the headband length.

5. The method according to claim 4, further including the step of bending the headband length for holding to a user's head.

6. A method of making a headset, comprising the steps of:

a) forming an extrusion by forcing molten thermoplastic through a die, the die having an edge defining an extrusion transverse cross section shape, the thermoplastic emerging as a solidified strip at an extrusion speed;

b) simultaneously feeding a plurality of metal wires through the die at the extrusion speed, the wires separated from the edge and from each other, whereby the wires will be embedded internally within the solidified strip and electrically isolated;

c) cutting the extrusion to a headband length;

d) exposing a sufficient portion of the wires for making electrical connections thereto;

e) electrically coupling the wires to a first sound transducer;

f) mechanically attaching the first sound transducer to the headband length;

g) cutting the extrusion to a boom length;

h) selectively removing one of the wires from the boom length for leaving a tunnel therethrough;

i) threading electrically conductive signal leads through the tunnel; and j) electrically coupling the signal leads to a microphone transducer.

7. The method according to claim 6, wherein the wires include a steel wire and a copper wire, and further wherein the copper wire is the wire selectively removed from the boom length.

8. The method according to claim 6, wherein the molten thermoplastic has a first temperature and a first wire has a respective lower temperature within the die during the step of feeding metal wires through the die at the extrusion speed.

9. The method according to claim 6, wherein the thermoplastic is nylon.

10. The method according to claim 6, further including the step of mechanically joining the microphone to the boom length.

* * * * *

UNITED STATES PATENT AND TRADEMARK OFFICE

CERTIFICATE OF CORRECTION

PATENT NO. : 5,369,857

DATED : December 6, 1994

INVENTOR(S) : Jim Sacherman et al.

It is certified that error appears in the above-identified patent and that said Letters Patent is hereby corrected as shown below:

Column 7, line 57, insert "yokes" after "protruding".

Signed and Sealed this

Twenty-eight Day of February, 1995

*Attest:*

Bruce Lehman

BRUCE LEHMAN

*Attesting Officer*

*Commissioner of Patents and Trademarks*